US007697878B2

(12) United States Patent
Condello et al.

(10) Patent No.: US 7,697,878 B2
(45) Date of Patent: Apr. 13, 2010

(54) FUSER ASSEMBLIES, XEROGRAPHIC APPARATUSES AND METHODS OF FUSING TONER ON COPY SHEETS

(75) Inventors: Anthony S. Condello, Webster, NY (US); Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 101 days.

(21) Appl. No.: 12/111,373

(22) Filed: Apr. 29, 2008

(65) Prior Publication Data

US 2009/0269108 A1 Oct. 29, 2009

(51) Int. Cl.
*G03G 15/20* (2006.01)

(52) U.S. Cl. ..... 399/329; 219/216; 399/45; 399/69

(58) Field of Classification Search ..... 399/329, 399/45, 67, 69; 219/216; 347/156
See application file for complete search history.

(56) References Cited

U.S. PATENT DOCUMENTS 6,505,832 B2 1/2003 Moore et al.
6,865,364 B2 * 3/2005 Matsumoto ..... 399/329
7,361,863 B2 * 4/2008 Tsunoda ..... 219/216
7,480,478 B2 * 1/2009 Aze et al. ..... 399/328
2004/0042809 A1 * 3/2004 Fuma et al. ..... 399/67
2007/0092277 A1 * 4/2007 Miyata et al. ..... 399/69

* cited by examiner

*Primary Examiner*—Sophia S Chen
(74) *Attorney, Agent, or Firm*—Edward A. Brown; Prass LLP

(57) ABSTRACT

Fuser assemblies for fusing toner on copy sheets, xerographic apparatuses, and methods of fusing toner on copy sheets in xerographic apparatuses are disclosed. An embodiment of the fuser assemblies includes a continuous fuser belt including an inner surface and an outer surface opposite the inner surface; at least a first roll and a second roll which support the fuser belt, at least one of the first roll and second roll being adapted to heat the fuser belt; a heater including an outer heating surface facing the inner surface of the fuser belt; and a mechanism operatively connected to the heater for moving the heater to bring the heating surface into contact with the inner surface of the fuser belt. The heater is operable to supply heat from the heating surface to the inner surface to increase the temperature of the outer surface of the fuser belt adjacent the inner surface heated by the heating surface.

19 Claims, 5 Drawing Sheets

FUSER ASSEMBLIES, XEROGRAPHIC APPARATUSES AND METHODS OF FUSING TONER ON COPY SHEETS

BACKGROUND

Fuser assemblies, xerographic apparatuses, and methods of fusing toner on copy sheets in xerographic processes are disclosed.

In a typical xerographic printing process, a toner image is formed on a copy sheet, and then the toner is heated to a sufficiently high temperature to fuse the toner on the copy sheet. One process used for thermal fusing toner onto a copy sheet uses a belt fuser apparatus including a pressure roll, a fuser roll and a fuser belt positioned between these rolls. During operation, the copy sheet with a toner image is fed to a nip between the pressure and fuser rolls, and the pressure roll presses the copy sheet onto the fuser belt.

It would be desirable to provide fuser assemblies including fuser belts that can be used for mixed media print jobs and are energy efficient.

SUMMARY

According to aspects of the embodiments, there are provided fuser assemblies for fusing toner on copy sheets in xerographic apparatuses, xerographic apparatuses and methods of fusing toner on copy sheets in xerographic apparatuses. An exemplary embodiment of the fuser assemblies comprises a continuous fuser belt including an inner surface and an outer surface opposite the inner surface; at least a first roll and a second roll supporting the fuser belt, at least one of the first roll and second roll being adapted to heat the fuser belt; a heater including an outer heating surface facing the inner surface of the fuser belt; and a mechanism operatively connected to the heater for moving the heater to bring the heating surface into contact with the inner surface of the fuser belt. The heater is operable to supply heat from the heating surface to the inner surface to increase the temperature of the outer surface of the fuser belt adjacent the inner surface heated by the heating surface.

DRAWINGS

Figure 8A:
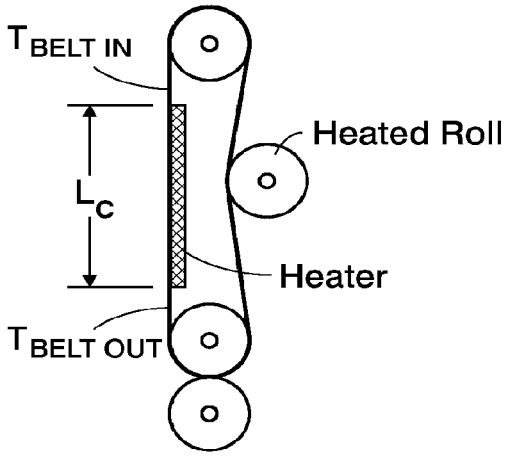
Figure 8B:
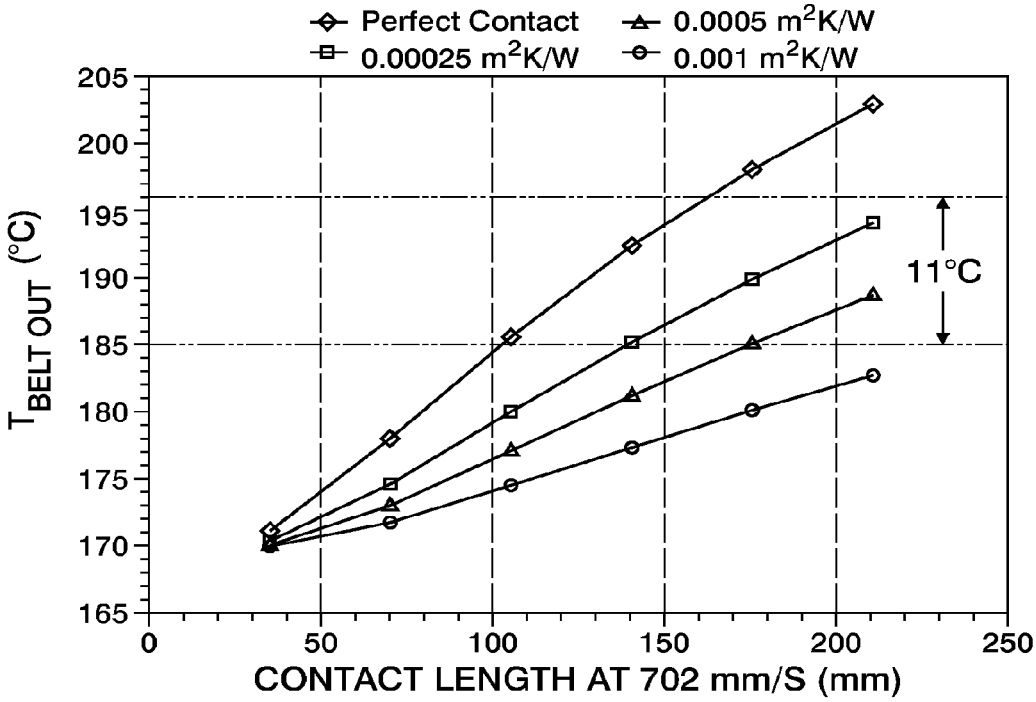

FIG. 8A shows an exemplary embodiment of a fuser assembly including a fuser belt supported on rolls and a heater in contact with a contact length of the fuser belt; and FIG. 8B shows a series of curves representing the calculated temperature at a downstream end of the contact length of the fuser belt contacted by the heating surface of the heater depicted in FIG. 8A versus the contact length for different values of thermal contact resistance between the fuser belt and the heating surface.

DETAILED DESCRIPTION

The disclosed embodiments include a fuser assembly for fusing toner onto a copy sheet, which comprises a continuous fuser belt including an inner surface and an outer surface opposite the inner surface; at least a first roll and a second roll which support the fuser belt, at least one of the first roll and second roll being adapted to heat the fuser belt; a heater including an outer heating surface facing the inner surface of the fuser belt; and a mechanism operatively connected to the heater for moving the heater to bring the heating surface into contact with the inner surface of the fuser belt. The heater is operable to supply heat from the heating surface to the inner surface to increase the temperature of the outer surface of the fuser belt adjacent the inner surface heated by the heating surface.

The disclosed embodiments further include a fuser assembly for fusing toner onto a copy sheet, which comprises a continuous fuser belt including an inner surface and an outer surface opposite the inner surface; at least a first roll and a second roll which support the fuser belt, at least one of the first roll and second roll being adapted to heat the fuser belt; a third roll; a nip defined between the second roll and the third roll; a heater disposed between the first roll and the second roll, the heater including an outer heating surface facing the inner surface of the fuser belt; and a mechanism operatively connected to the heater for pivoting the heater to bring at least a portion of the heating surface into contact with the inner surface of the fuser belt. The heater is operable to supply heat from the heating surface to the inner surface to increase the temperature of the outer surface of the fuser belt adjacent the inner surface heated by the heating surface.

The disclosed embodiments further include a method of fusing toner onto a copy sheet in a xerographic apparatus. The method comprises heating a fuser belt including an inner surface and an outer surface with at least one of a first roll and a second roll which support the fuser belt; heating at least a portion of the inner surface of the fuser belt between the first roll and second roll by contacting the portion of the inner surface with a heating surface of a heater; conveying a first copy sheet having first toner thereon to a nip defined between the second roll and a third roll; and contacting the first copy sheet with a portion of the outer surface of the fuser belt opposite to the portion of the inner surface heated by the heating surface to heat the first toner to a first temperature effective to fuse the first toner onto the first copy sheet.

Figure 1:
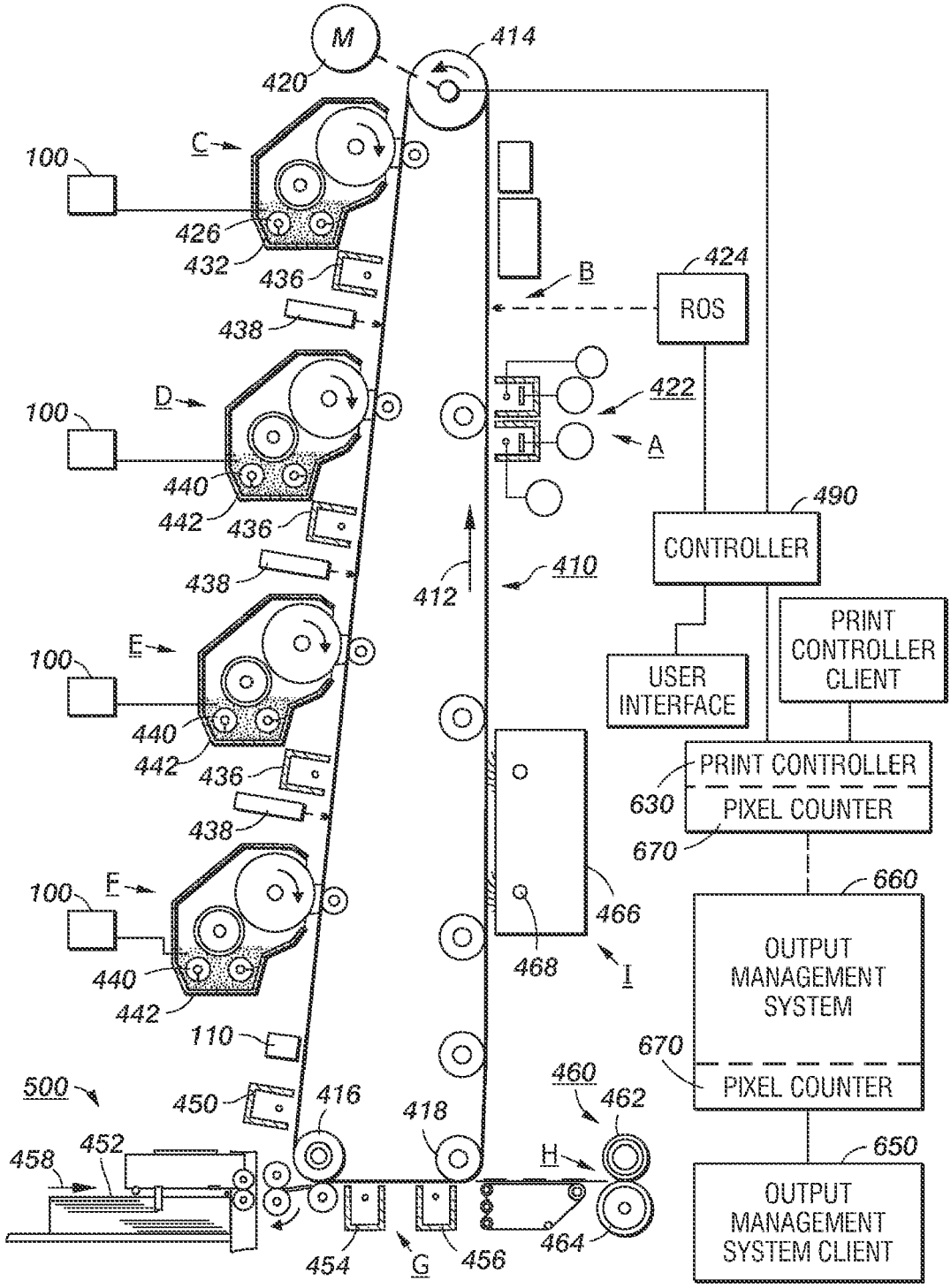
FIG. 1 illustrates an exemplary embodiment of a xerographic apparatus.

FIG. 1 illustrates an exemplary xerographic apparatus (digital imaging system) in which embodiments of the disclosed fuser assemblies can be used. Such digital imaging systems are disclosed in U.S. Pat. No. 6,505,832, which is hereby incorporated by reference in its entirety. The imaging system is used to produce an image, such as a color image output in a single pass of a photoreceptor belt. It will be understood, however, that embodiments of the fuser assemblies can be used in other imaging systems. Such systems include, e.g., multiple-pass color process systems, single or multiple pass highlight color systems, or black and white printing systems.

As shown in FIG. 1, an output management system 660 can supply printing jobs to a print controller 630. Printing jobs can be submitted from the output management system client 650 to the output management system 660. A pixel counter 670 is incorporated into the output management system 660 to count the number of pixels to be imaged with toner on each sheet or page of the job, for each color. The pixel count information is stored in the memory of the output management system 660. The output management system 660 submits job control information, including the pixel count data, and the printing job to the print controller 630. Job control information, including the pixel count data and digital image data, are communicated from the print controller 630 to the controller 490.

The xerographic apparatus can use a charge retentive surface in the form of an active matrix (AMAT) photoreceptor belt 410 supported for movement in the direction of arrow 412, for advancing sequentially through the various xerographic process stations. In the embodiment, the photoreceptor belt 410 is a continuous (endless) belt supported on a drive roll 414, tension roll 416 and fixed roll 418. The drive roll 414 is operatively connected to a drive motor 420 for moving the photoreceptor belt 410 sequentially through the xerographic stations.

During the printing process, a portion of the photoreceptor belt 410 passes through a charging station A including a corona generating device 422, which charges the photoconductive surface of photoreceptor belt 410.

Next, the charged portion of the photoconductive surface of the photoreceptor belt 410 is advanced through an imaging/exposure station B. At the imaging/exposure station B, a controller 490 receives image signals from the print controller 630 representing the desired output image, and processes these signals to convert them to signals transmitted to a laser-based output scanning device, which causes the charged surface to be discharged in accordance with the output from the scanning device. In the exemplary system, the scanning device is a laser raster output scanner (ROS) 424.

The photoreceptor belt 410, which is initially charged to a voltage $V_0$, undergoes dark decay. When exposed at the exposure station B, the photoreceptor belt 410 is discharged. After exposure, the photoreceptor belt 410 contains a monopolar voltage profile of high and low voltages, with the high voltages corresponding to charged areas and the low voltages corresponding to discharged or developed areas.

At a first development station C, comprising a developer structure 432 utilizing a hybrid development system, a developer roll is powered by two developer fields. The first field is the AC field, which is used for toner cloud generation. The second field is the DC developer field which is used to control the amount of developed toner mass on the photoreceptor belt 410. The toner cloud causes charged toner particles 426 to be attracted to the electrostatic latent image. Appropriate developer biasing is accomplished via a power supply. This type of system is a non-contact type in which only toner particles (black, for example) are attracted to the latent image and there is no mechanical contact between the photoreceptor belt 410 and a toner delivery device to disturb a previously developed, unfixed image. A toner concentration sensor 100 senses the toner concentration in the developer structure 432.

The developed image is then transported past a second charging device 436 where the photoreceptor belt 410 and developed toner image areas are recharged to a predetermined level.

A second exposure/imaging is performed by device 438 including a laser-based output structure, which selectively discharges the photoreceptor belt 410 on toned areas and/or bare areas, pursuant to the image to be developed with the second color toner. At this point of the process, the photoreceptor belt 410 contains toned and untoned areas at relatively high voltage levels, and toned and untoned areas at relatively low voltage levels. These low voltage areas represent image areas, which are developed using discharged area development (DAD). A negatively-charged, developer material 440 comprising color toner is employed. The toner, e.g., yellow toner, is contained in a developer housing structure 442 disposed at a second developer station D and is transferred to the latent images on the photoreceptor belt 410 using a second developer system. A power supply (not shown) electrically biases the developer structure to a level effective to develop the discharged image areas with negatively charged yellow toner particles. Further, a toner concentration sensor can be used to sense the toner concentration in the developer housing structure 442.

The above procedure is repeated for a third image for a third suitable color toner, such as magenta (station E), and for a fourth image and suitable color toner, such as cyan (station F). The exposure control scheme described below may be utilized for these subsequent imaging steps. In this manner, a full-color composite toner image is developed on the photoreceptor belt 410. In addition, a mass sensor 110 measures developed mass per unit area.

In case some toner charge is totally neutralized, or the polarity reversed, thereby causing the composite image developed on the photoreceptor belt 410 to consist of both positive and negative toner, a negative pre-transfer dicorotron member 450 can condition the toner for transfer to a copy sheet using positive corona discharge.

Subsequent to image development, a copy sheet 452 (e.g., paper) is moved into contact with the toner images at transfer station G. The copy sheet 452 is advanced to transfer station G by a sheet feeding apparatus 500. The copy sheet 452 is then brought into contact with the photoconductive surface of photoreceptor belt 410 in a timed sequence so that the toner powder image developed on the photoreceptor belt 410 contacts the advancing copy sheet 452 at the transfer station G.

The transfer station G includes a transfer dicorotron 454, which sprays positive ions onto the backside of the copy sheet 452. The ions attract the negatively charged toner powder images from the photoreceptor belt 410 to the copy sheet 452. A detack dicorotron 456 is provided for facilitating stripping of copy sheets from the photoreceptor belt 410.

After transfer of the toner images, the copy sheet continues to move, in the direction of arrow 458, onto a conveyor (not shown). The conveyor advances the copy sheet to a fusing station H. The fusing station H includes a fuser assembly 460 for permanently affixing the transferred powder image to the copy sheet 452. The fuser assembly 460 comprises a heated fuser roll 462 and a pressure roll 464. The copy sheet 452 passes between the fuser roll 462 and pressure roll 464 with the toner powder image contacting the fuser roll 462, causing the toner powder images to be permanently affixed to the copy sheet 452. After fusing, a chute (not shown) guides the advancing copy sheet 452 to a catch tray, stacker, finisher or other output device (not shown), for subsequent removal from the printing apparatus by the operator. The fuser assembly 460 can be contained within a cassette, and can include additional elements not shown in FIG. 1, such as a belt around the fuser roll 462.

After the copy sheet 452 is separated from the photoconductive surface of the photoreceptor belt 410, residual toner particles carried by the non-image areas on the photoconductive surface are removed from the photoconductive surface. These toner particles are removed at cleaning station I using a cleaning brush structure contained in a housing 466. The cleaning brushes 468 are engaged after the composite toner image is transferred to a copy sheet.

The controller 490 is operable to regulate the various printer functions. The controller 490 can be a programmable controller operable to control printer functions described above.

Xerographic apparatuses can be used for print jobs where all media are of the same type (e.g., same thickness), as well as for mixed-media print jobs. A mixed-media print job can consist of media having different thicknesses (weights). The media can be coated or uncoated. For example, a mixed-media print job can include different combinations of thin/uncoated, thin/coated, thick/uncoated and thick/coated paper sheets. Each type of media typically has its own optimum set temperature for achieving a desired gloss and toner fix during the fusing step. The amount of heat (thermal energy) that needs to be supplied to thicker copy sheets to fuse toner on them exceeds the amount of heat that needs to be supplied to thinner copy sheets of the same material to fuse the same toner on the thinner sheets. More energy is needed to affix toner on coated sheets than on uncoated sheets. These different characteristics of different media increase the difficulty of achieving full productivity and image quality consistency in mixed-media print jobs.

In order to print different types of media in a single print job, using a fuser assembly including a fuser belt, the temperature of the fuser belt can be changed during the print job. For example, toner can be fused on thin sheets at a first temperature set point of the fuser belt. To then heat thick copy sheets in the print job to a sufficiently-high temperature to fuse toner on the thick sheets, the temperature of the fuser belt can be increased from the first temperature set point to a higher second temperature set point. Increasing the temperature of the fuser belt to a higher temperature set point during a print job requires increasing the amount of heat supplied to the fuser belt by heated rolls of the fuser assembly. However, due to the thermal mass of the rolls, heating the fuser belt from a lower temperature set point to a higher temperature set point by increasing the temperature of the heated rolls can take, e.g., 30 seconds or more, and consequently produce a significant time delay in the printing job.

To avoid such time delays in mixed-media print jobs (e.g., a print job in which at least one thick sheet is mixed with thin sheets), the xerographic apparatus can be programmed to begin to increase the amount of heat supplied to the fuser belt before the thick sheet is printed. During this heat-up period, the apparatus continues to print thin sheets. However, thin sheets included in the print job that are fused at the higher temperature set point prior to fusing the thick sheet can be over-fused by being heated to the higher temperature. Consequently, these printed thin sheets can have defects, such as different gloss, mis-strip, or hot offset.

Figure 2:
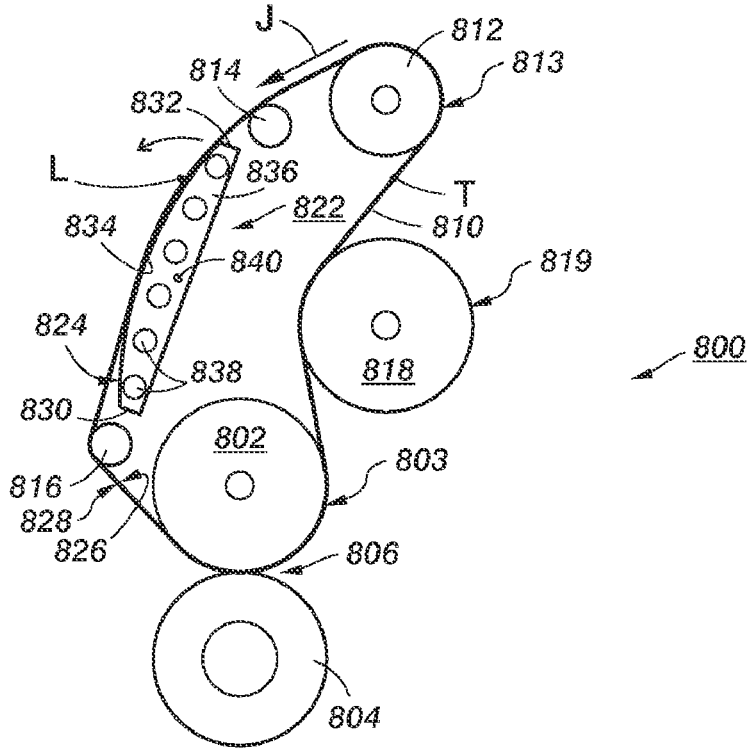
FIG. 2 illustrates an exemplary embodiment of a fuser assembly including a heater positioned such that an upstream portion of a heating surface of the heater contacts a portion of a fuser belt.
Figure 3:
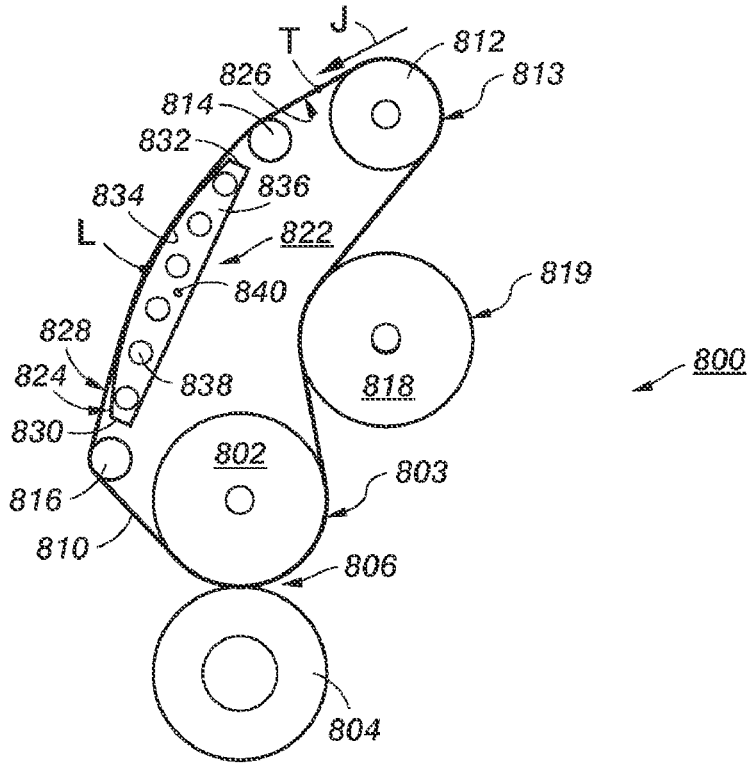
FIG. 3 illustrates the fuser assembly of FIG. 2 with the heater positioned such that a larger portion of the heating surface of the heater contacts the fuser belt.
Figure 4:
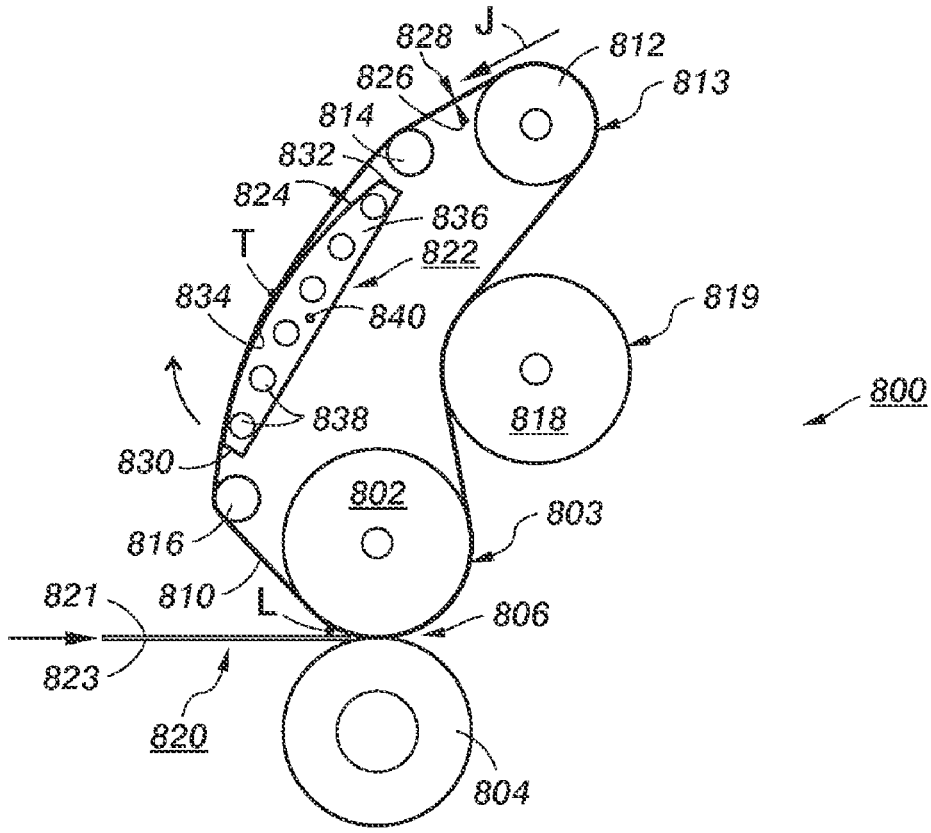
FIG. 4 illustrates the fuser assembly of FIG. 2 with the heater positioned such that a downstream portion of the heating surface of the heater contacts the fuser belt.

FIGS. 2 to 4 illustrate an exemplary embodiment of a fuser assembly 800. The fuser assembly 800 is constructed to be able to provide more thermally-efficient fusing of toner on copy sheets in mixed-media print jobs, without occurrences of over-fusing of copy sheets. The fuser assembly 800 can be used in different types of xerographic apparatuses. For example, the fuser assembly 800 can be incorporated in the xerographic apparatus shown in FIG. 1, in place of the fuser assembly 460.

Embodiments of the fuser assemblies include a fuser belt which is supported by at least two rolls. In the embodiment shown in FIGS. 2 to 4, the fuser assembly 800 includes a fuser roll 802, a pressure roll 804 and a nip 806 between these rolls. The fuser assembly 800 also includes a belt roll 812, idler rolls 814, 816 located between the belt roll 812 and the fuser roll 802, and a tensioning roll 818 located between the fuser roll 802 and belt roll 812. An endless (continuous) fuser belt 810 is supported on the fuser roll 802, idler rolls 814, 816, belt roll 812, and tensioning roll 818. The fuser belt 810 is driven to rotate in the counter-clockwise direction as indicated by arrow J by a suitable mechanism, such as a stepper motor (not shown).

In the fuser assembly 800, at least one of the fuser roll 802, belt roll 812 and tensioning roll 818 are internally heated. In some embodiments, each of these rolls is internally heated. These rolls can be heated internally with one or more heating elements, such as at least one quartz lamp or quartz rod, located in the interior of the rolls. The heating elements are powered to heat the outer surface 803, 813 and 819 of the one or more of the rolls 802, 812 and 818 that are heated. The idler rolls 814, 816 typically are not heated. The fuser belt 810 has in inner surface 826 and an outer surface 828 opposite to the inner surface 826. The heated fuser roll 802, belt roll 812 and/or tensioning roll 818 heat the inner surface 826 and/or the outer surface 824 (tensioning roll 8189) of the fuser belt 810 by conduction. The amount of heat supplied to the fuser belt 810 by the heated rolls is based on the temperature set point for the fuser belt 810, which is based on the type of media to be printed using the heated fuser belt.

An exemplary embodiment of the fuser belt 810 comprises a base layer of polyimide, or the like; a layer of silicone on the base layer; and an outer layer (release layer) of polytetrafluoroethylene (TEFLON), or the like, on the silicone layer. Typically, the base layer has a thickness of about 50 μm to about 100 μm, the silicone layer has a thickness of about 200 μm to about 400 μm, and the outer layer has a thickness of about 20 μm to about 40 μm. The fuser belt 810 has a width at least equal to the width of copy sheets that are fed to the fuser assembly 800.

In embodiments of the fuser assembly 800, the fuser belt 810 can have a length of at least about 500 mm, such as at least about 600 mm, 700 mm, 800 mm, 900 mm, 1000 mm, or even longer. The primary failure modes of belt fusers are typically attributed to the life of the fuser belt. Using a longer fuser belt for embodiments of the fuser belt 810 provides more surface area available for wear than shorter belts have, and can increase the service life of the fuser belt 810.

During operation of the fuser assembly 800, a copy sheet 820 (FIG. 4) with at least one toner image (e.g., text and/or other types of images) on at least the surface 821 is fed to the nip 806 by a sheet feeding apparatus. At the nip 806, the outer surface 828 of the rotating fuser belt 810 contacts the surface 821 of the copy sheet 820, and the opposite surface 823 of the copy sheet 820 contacts the pressure roll 804. The fuser belt 810 and pressure roll 804 apply sufficient heat and pressure to the copy sheet 820 to fuse the toner on the copy sheet 820. The fusing temperature for fusing the toner on the copy sheet 820 is based on factors including the thickness of the copy sheet 820 and whether the copy sheet 820 is coated or uncoated. The fusing temperature is typically about 180° C. to about 200° C.

In the embodiment, the fuser assembly 800 includes a heater 822 located inside of the fuser belt 810 (i.e., inside the inner perimeter of the fuser belt 810). The heater 822 is adapted to heat at least a portion of the length of the fuser belt 810 before this portion rotates to the nip 806 and contacts a copy sheet. As shown, the heater 822 is located along the fuser belt 810 between the belt roll 812 and the fuser roll 802.

Desirably, the heater 822 is located close to the fuser roll 802 in order to reduce cooling of the portion of the fuser belt 810 that has been heated by the heater 822 before that portion of the fuser belt 810 rotates to the nip 806.

The heater 822 includes an outer heating surface 824 facing the inner surface 826 of the fuser belt 810. The heater 822 is adapted to be movable in order to move the heating surface 824 relative to the inner surface 826 of the fuser belt 810. At least a portion of the heating surface 824 can be moved into intermittent contact with the inner surface 826. The heater 822 is operable to supply heat from the heating surface 824 to the portion of the inner surface 826 that contacts the heating surface 824. Heat supplied to the inner surface 826 by the heater 822 is conducted to the outer surface 828 of the fuser belt 810 adjacent the heated portion of the inner surface 826. The heater 822 is adapted to be able to rapidly increase the temperature of the outer surface 828 of the fuser belt 820 along a selected length of the fuser belt 810 that the heating surface 826 contacts.

In an embodiment, the one or more heated rolls of the fuser assembly 800 are adapted to be able to supply a sufficient amount of power to the fuser belt 810 to fuse toner on thin copy sheets (e.g., thin paper sheets). The heater 822 has a sufficient heating capacity to be able to supply the entire additional amount of power needed to fuse toner on thick copy sheets (i.e., the difference between the amount of power needed to fuse toner on thick copy sheets and thin copy sheets), or the additional amount of power needed to fuse toner on coated sheets as opposed to un-coated sheets (i.e., the difference between the amount of power needed to fuse toner on coated copy sheets and un-coated copy sheets). By using the heater 822, toner can be fused on thick copy sheets and/or coated sheets without having to increase the temperature set point and supply the additional amount of power from the heated roll(s) to the fuser belt 810.

Figure 5:
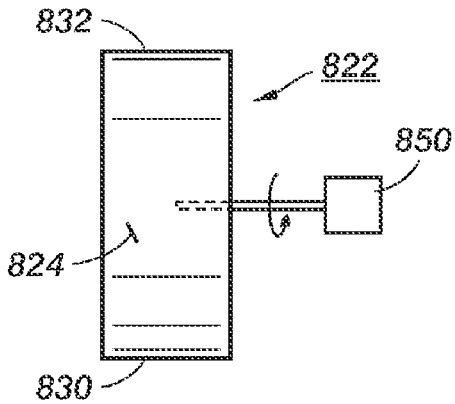
FIG. 5 illustrates an embodiment of a mechanism for moving the heater of the fuser assembly shown in FIG. 2.

The amount of surface area contact between the heating surface 824 of the heater 822 and the inner surface 826 of the fuser belt 810 is controlled by moving the heater 822 (and heating surface 824) relative to the inner surface 826. The heating surface 824 can be moved relative to the inner surface 826 depending on the characteristics of the incoming media included in the print job. The fuser assembly 800 includes a mechanism operatively connected to the heater 822 for moving the heater 822 (and heating surface 824) relative to the fuser belt 810. As shown in FIG. 5, an embodiment of the mechanism includes a shaft 840 fixedly attached to the heater 822, such that the heater 822 does not rotate relative to the shaft 840 and rotates by the same amount as the shaft 840. The shaft 840 is connected to a motor 850, which can rotate the shaft 840 in clockwise and counter-clockwise directions. Rotation of the shaft 840 causes the heater 822 to pivot relative to the inner surface 826. The motor 850 can be controlled by a fuser controller (not shown) connected to the motor 850 and heater 822.

In embodiments, the mechanism for moving the heater can be controlled to match the speed of the fuser belt 810 in order to reduce the response time of the heater 822 when it is desired to change the temperature of a portion of the fuser belt 810.

The heating surface 824 of the heater 822 can have any suitable size and shape for engaging with and heating the fuser belt 810. In the embodiment, the heating surface 824 is curved (i.e., convex shaped). The heating surface 824 has a downstream end 830 and an upstream end 832 (downstream end) opposite to the downstream end 830. The curved shape of the heating surface 824 can reduce the transition stress for contact between the fuser belt 810 and heater 822 at the downstream end 830 and upstream end 832 of the heating surface 824. The curvature of the heating surface 824 can be varied from the curvature shown in FIGS. 2 to 4 to increase or decrease the maximum amount of surface area contact that can be achieved between the heating surface 824 and the fuser belt 810. The heating surface 824 can be shaped such that a portion up to the entire heating surface 824 can be brought into contact with the inner surface 826.

The distance from the downstream end 830 to the upstream end 832 over the heating surface 824 can typically be about 150 mm to about 300 mm. The heating surface 824 can typically have a width equal to at least the width of the fuser belt 810.

The heater 822 is selectively operable to heat the inner surface 826 of the fuser belt 810 during movement of the fuser belt 810. The heater 822 can be operated to increase the temperature of the portion(s) of the fuser belt 810 that come (s) into contact with thick media and/or coated media to a temperature effective to fuse toner on such media. The timing, and the surface area, of the contact between the heating surface 824 and the inner surface 826 is controllable by the fuser controller so that heat can be supplied to about the length (and width) of the fuser belt 810 that contacts the copy sheet 820 at the nip 806. In embodiments, portions of the fuser belt 810 adjacent this length (both upstream and downstream) can also be heated by the heater 822. By heating the adjacent portions of the fuser belt 810, cooling near the leading and trailing ends of the copy sheet 820 contacted by the fuser belt 810 can be reduced.

To heat the fuser belt 810, the moving mechanism can be actuated to move a selected portion of the heating surface 824 into engagement with the inner surface 826. This engagement can range from partial engagement (i.e., a portion of the heating surface 824 contacts the inner surface 826) to full engagement (i.e., the entire heating surface 824 contacts the inner surface 826). The amount of contact between the heating surface 824 and the inner surface 826 can be determined based on the particular characteristics of the incoming media. The heater 822 can be controlled to supply a sufficient amount of heat from the heating surface 824 to the inner surface 826 to heat the length of the fuser belt 810 in contact with the heating surface 824 to the desired temperature. The temperature of the fuser belt 810 is typically measured at the outer surface 828, which contacts with copy sheets during fusing of toner on the copy sheets. The engagement of the heating surface 824 with the fuser belt 810, when timed to correspond to the process speed of the fuser belt 810, directly translates to increased thermal energy being supplied to only about the desired process length of the fuser belt 810. The desired process length can correspond to only about the length of a copy sheet in order to provide efficient heating of the fuser belt 810.

In embodiments, the heater 822 can optionally be controlled to supply heat to a continuous length of the fuser belt 810 that is longer than the length of a single copy sheet, in order to heat this longer length to the desired temperature. The continuous length can be up to the entire length of the fuser belt 810. To heat the longer length, the heating surface 824 is kept in contact with the inner surface 824 of the fuser belt 810 corresponding to the longer length. This heating mode can be used, e.g., for processing successive thick sheets and/or coated sheets during a print job.

The heater 822 is constructed to heat the fuser belt 810 directly by conduction. The heater 822 has a sufficient heating capacity to heat the selected portion of the fuser belt 810 to the desired higher temperature within the time period that it takes for the selected portion of the fuser belt 810 to travel over the entire length of the heating surface 824. Typically, the portion of the fuser belt 810 can be heated to the desired temperature within only seconds by the heater 822. For example, in the embodiment shown in FIGS. 2 to 4, to heat the length, $I_{L-T}$, of the fuser belt 810 located between the points L and T, the selected period of time, t, is equal to $I_{L-T}$ divided by the steady-state velocity, $v_{fuser\ belt}$, of the fuser belt 820, i.e., $t=I_{L-T}/V_{fuser\ belt}$. For a standard 8.5 inch (216 mm)×11 inch (279 mm) sheet of paper, and an exemplary fuser belt speed of about 700 mm/s, t equals about 0.4 seconds. In embodiments of the fuser assembly 800, the heater 822 can heat the portion of the fuser belt 810 located between the points L and T within this amount of time.

The portion of the fuser belt 810 located between the points L and T, which has been heated to the desired temperature by the heater 822, is rotated to the nip 806. The movement of the fuser belt 810 and the feeding of the copy sheet 820 to the nip 806 is timed so that the outer surface 828 of the heated portion of the fuser belt 810 contacts with the copy sheet 820 at the nip 806. Heat conducted from the outer surface 828 of the fuser belt 810 increases the temperature of the copy sheet 820 to the desired temperature for fusing toner on the copy sheet 820. The copy sheet 820 can be thick and/or coated. The amount of heat supplied to the copy sheet 820 by the portion of the fuser belt 810 between endpoints L and T is sufficient to heat the thick and/or coated copy sheet 820 to a temperature effective to fuse the toner.

The heater 822 includes at least one heat source, which is powered to heat the outer portion 834 including the heating surface 824. In the embodiment, the heater 822 has an interior 836 in which multiple heating elements 838 are contained. The heating elements 838 can be, e.g., quartz lamps or rods. The heating elements 838 can be approximately evenly spaced from each other along the length of the heater 822, as shown. The heater 822 can include a single row of the heating elements 838, as shown, or it can include two or more rows, with the heating elements of adjacent rows being spaced from each other in the width dimension of the heater 822. The heating elements 838 are connected to a suitable power supply (not shown) connected to the fuser controller. The heating elements 838 can be powered to heat the entire heating surface 824 to an approximately constant temperature along the length and width of the heating surface 824. Alternatively, selected ones of the heating elements 828 can be powered to produce a non-uniform temperature profile along the length and/or width of the heating surface 824.

The outer portion 834 of the heater 822 is comprised of a material having the desired thermal conductivity properties. In an embodiment, the outer portion 834 (and optionally also the remainder of the outer wall of the heater 822) is comprised of metal. The heating surface 824 of the heater 822 can optionally have a coating of a thermally-conductive, lubricating material (e.g., a fluoroelastomer) formed on an outer surface of the metal and being effective to reduce friction between the inner surface 826 of the fuser belt 810 and the heating surface 824 in contact with the inner surface 826. In an embodiment, the outer portion 834 has sufficiently-high thermal mass (i.e., sufficiently-high specific heat, volume and density, and sufficiently-low thermal conductivity) to be able to store heat so that the heating surface 824 remains at a temperature of, e.g., less than the fusing temperature of toner on thin and/or uncoated sheets, when the heating elements 838 are idling at a reduced power level prior to fusing toner on thick and/or coated copy sheets in the print job. When the heater 822 is idling, the heating elements 838 can be quickly powered to heat the portion of the fuser belt 810 that will come into contact with a thick and/or coated sheet, when that portion of the fuser belt 810 comes into contact with the heating surface 824 (i.e., before point L of the fuser belt 810 reaches the upstream end 832 of the heating surface 824).

The controlled engagement of the heating surface 824 with the inner surface 826 of the fuser belt 810 can be achieved in different ways. For example, in the embodiment of the fuser assembly 800 shown in FIGS. 2 to 4, the heater 822 can be pivoted such that the length of the inner surface 826 of the fuser belt 810 that contacts the heating surface 824 is heated equally during movement of the fuser belt 810. The total contact length between the heating surface 824 and the inner surface 826 can be controlled by the timing of this contact, and also by the relative amount of engagement of the heating surface 824 with the inner surface 826, and can range from partial to full engagement. The pivotal engagement of the heating surface 824 allows control of the particular portion, and the total surface area, of the heating surface 824 that contacts with the inner surface 826 of the fuser belt 810.

As shown in FIG. 2, the shaft 840 can be rotated by the motor 850 to pivot the heater 822 counter-clockwise and bring a portion of the length of the heating surface 824 (e.g., about one-half of the length of the heating surface 824, as shown) into contact with the inner surface 826 of the fuser belt 810. The heater 822 can be pivoted to the position shown in FIG. 2 before point L of the fuser belt 810 reaches the upstream end 832 of the heating surface 824.

As shown in FIG. 3, subsequently, the shaft 840 can be rotated to pivot the heater 822 clockwise and bring a substantial portion of the heating surface 824 into contact with the inner surface 826 of the fuser belt 810. Portions of the heating surface 824 adjacent the upstream end 832 and downstream end 830 are not in contact with the inner surface 826. The curvature of the heating surface 824 can be varied from the curvature shown in FIGS. 2 to 4 such that the entire heating surface 824 can be brought into contact with the inner surface 826.

As shown in FIG. 4, the heater 822 can then be pivoted clockwise on the shaft 840 from the position shown in FIG. 3 to bring a portion of the length of the heating surface 824 (e.g., about one-half of the length of the heating surface 824, as shown) into contact with the inner surface 826 of the fuser belt 810. The heater 822 can be pivoted clockwise from the position shown in FIG. 3 to the position shown in FIG. 4 when the point T of the fuser belt 810 is at about the center of the outer surface 824 of the heater 822.

Figure 6:
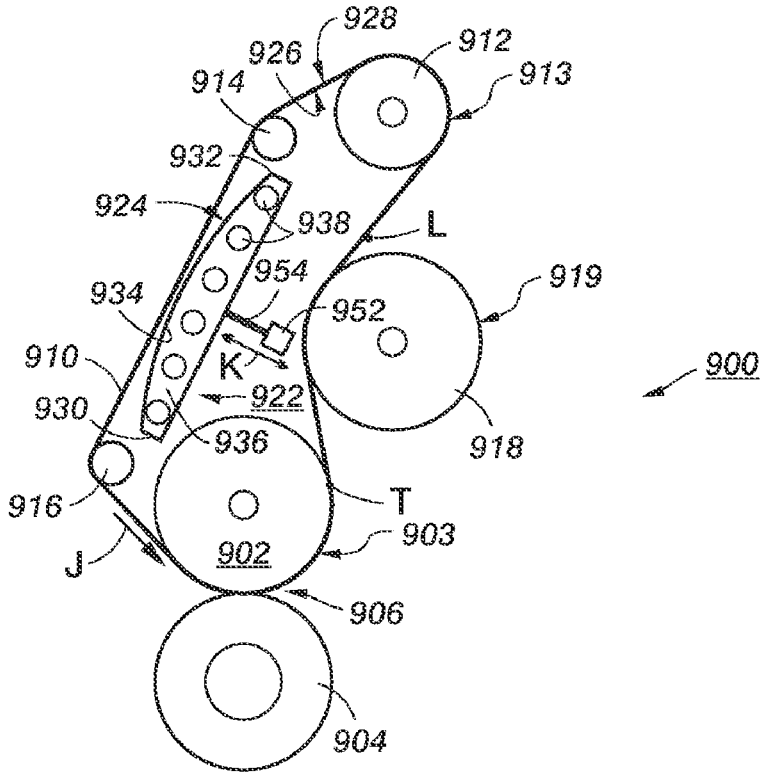
FIG. 6 illustrates another exemplary embodiment of the fuser assembly, which includes a heater having a heating surface spaced from the fuser belt.

A fuser assembly 900 according to another embodiment is shown in FIG. 6. The fuser assembly 900 includes a heater 922 with a heating surface 924. The illustrated embodiment of the fuser assembly 900 has the same components as the fuser assembly 800, except for having a different mechanism for moving the heater 922. The fuser assembly 900 includes a fuser roll 902 with an outer surface 903, pressure roll 904, belt roll 912 with an outer surface 913, idler rolls 914 and 916, tensioning roll 918 with an outer surface 919, and a fuser belt 910 with an inner surface 926 and outer surface 928. The heater 922 includes a downstream end 930, upstream end 932, outer portion 934 and interior 936. As shown, the heating surface 924 can have the same shape as the heating surface 824 of the fuser assembly 800. The heater 922 can be moved into contact with the inner surface 926 to heat a selected portion of the fuser belt 910 (e.g., a portion that contacts a thick and/or coated copy sheet at the nip 906), and then completely disengaged from the inner surface 926 of the fuser belt 910 when the portion of the fuser belt 910 has been heated to the desired temperature.

In the embodiment, the fuser assembly 900 includes a mechanism for moving the heater 922 toward and away from the fuser belt 910 by translation, without rotation, of the heater 922, as indicated by arrow K, to produce contact and then end contact, between the heating surface 924 and the inner surface 926 of the fuser belt 910. The mechanism includes a linear solenoid 952 with a plunger 954 secured at one end to the heater 922. The plunger 954 has an axial stroke to provide push-pull action to move the heating surface 924 toward and away from the inner surface 926 of the fuser belt 910. The plunger 954 is shown in the retracted position, in which the heating surface 924 is spaced from the inner surface 926. When a thick and/or coated copy sheet is coming to the nip 906, the fuser controller engages the heater 922 prior to arrival of the copy sheet, and disengages the heater 922 prior to arrival of a thin (and uncoated) copy sheet. When the heating surface 924 is engaged with the fuser belt 910, the heater 922 can be powered to supply sufficient heat to the inner surface 926 in contact with the heating surface 924 in order to heat a selected length of the fuser belt 910 to the desired temperature. The heater 922 can be moved toward the fuser belt 910 to bring the entire heating surface 924 into contact with the inner surface 926 at once. Then, the solenoid 952 can be activated to retract the plunger 954 to completely disengage, at once, the heating surface 924 from the fuser belt 910 to discontinue heating of the fuser belt 910.

In another embodiment of the fuser assembly, the mechanism for moving the heater relative to the fuser belt can be operable to both rotate and translate the heater for heating the fuser belt.

Figure 7:
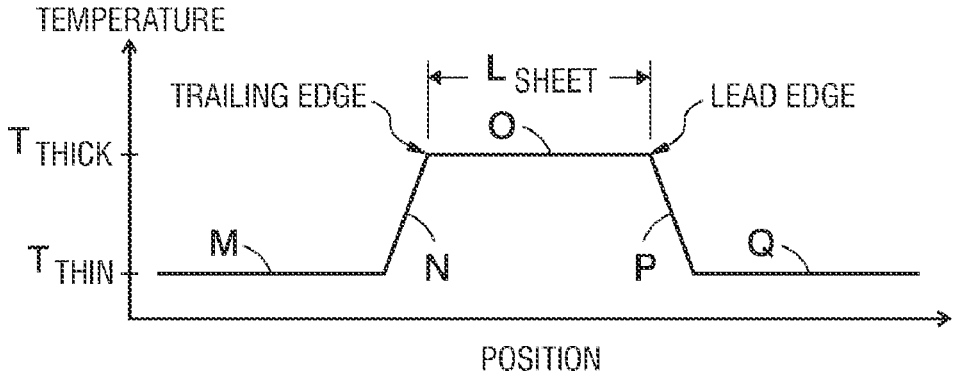
FIG. 7 shows an exemplary temperature versus position profile for the fuser belt of the fuser assembly shown in FIGS. 2 to 4 after a portion of the fuser belt has been heated by the heater.

FIG. 7 shows an estimated fuser belt outer surface temperature versus position curve for an embodiment of the fuser assembly 800 shown in FIGS. 2 to 4 after the fuser belt 810 has been heated by the heater 822, i.e., after point T of the fuser belt 810 has been rotated past the downstream end 830 of the heating surface 824. Segment M of the curve represents the temperature of a portion of the fuser belt 810 located upstream of point T that has not been heated by the heater 822. In this example, the temperature of this portion of the fuser belt 810 is equal to the fusing temperature for a thin sheet, $T_{THIN}$.

Segment N of the curve represents a portion of the fuser belt 810 upstream of, and adjacent, point T of the fuser belt 810. As shown, the temperature of this portion of the fuser belt 810 increases from $T_{THIN}$ to the fusing temperature for a thick sheet, $T_{THICK}$.

Segment O of the curve represents the portion of the fuser belt 810 located between points L and T ($L_{SHEET}$), which has been heated by the heating surface 824 to the temperature $T_{THICK}$.

Segment P of the curve represents a portion of the fuser belt 810 downstream of, and adjacent, point L of the fuser belt 810. As shown, the temperature of this portion of the fuser belt 810 decreases from $T_{THICK}$ to $T_{THIN}$.

Segment Q of the curve represents the temperature of the portion of the fuser belt 810 downstream of point L that has not been heated by the heater 822. The temperature of this portion of the fuser belt 810 is equal to $T_{THIN}$.

Referring to FIG. 6, in the fuser assembly 900, engagement of the entire heating surface 924 with the fuser belt 910 at once produces a fuser belt temperature profile that is less of a step function than the profile depicted in FIG. 7.

Embodiments of the fuser assemblies can be used in print jobs for fusing toner on copy sheets that are all thick, all coated, or have different thicknesses and optionally are also coated. For example, the fuser assemblies 800, 900 can be used in xerographic apparatuses for print jobs in which all copy sheets have the same thickness (e.g., all thick sheets), some copy sheets have different thicknesses, and/or copy sheets are coated and un-coated. The fuser assemblies 800, 900 can keep the temperature set point of the fuser belt 810, 910 more uniform by using the heater 822, 922 as a supplemental heat source. For example, in a mixed-media print job, to fuse toner on a thin copy sheet 820 using the fuser assemblies 800, 900, respectively, the heater 822 shown FIGS. 2 to 4 can be turned OFF, and the heater 922 shown in FIG. 6 can be moved away from contact with the fuser belt 910, so that the portions of the fuser belts 810, 910 that contact a copy sheet at the nips 806, 906 has not been heated by the heaters 822, 922, and is at approximately the temperature set point of the fuser belts 810, 910 when reaching the nip 806, 906. The temperature set point of the fuser belt 810, 910 is reached by the heated rolls of the fuser assemblies 800, 900 heating the fuser belts 810, 910. The fuser belts 810, 910, in turn, supply sufficient heat to the thinner copy sheet in the nips 806, 906 to fuse toner on the copy sheet.

Then, when a thick copy sheet is to be printed using the fuser assembly 800, or the fusing assembly 900, the heating surface 824, 924 of the heater 822, 922, is moved into contact with the fuser belt 810, 910 to heat a portion of the fuser belt 810, 910 to a sufficiently-high temperature, such that the fuser belt 810, 910 can supply sufficient additional heat to the copy sheet at the nip 806, 906 to fuse toner on the thick copy sheet (i.e., heat in addition to the heat supplied to the thin copy sheet by the fuser belt 810, 910 when heated only by the heated rolls). Due to having a lower thermal mass than the heated rolls, the heater 822, 922 can be powered to heat the selected portion of the fuser belt 810, 910 to the desired temperature for heating the thick copy sheet more quickly than the fuser belt 810, 910 can be heated to a higher temperature set point corresponding to the desired temperature by increasing the heat output of the heater rolls of the fuser assembly 800. The heating surface 824, 924 is heated to a higher temperature than the higher temperature set point. For example, the heating surface 824, 924 can be heated to a temperature that is about 30° C. to about 50° C. higher than the temperature set point for a thick copy sheet. Due to the relatively large amount of power needed to heat the entire fuser belt 810, 910, especially when the fuser belt 810, 910 has a longer length (e.g., greater than 500 mm) to a higher set point, it is also more energy efficient to heat the portion of the fuser belt 810, 910 with the heater 822, 922, as compared to increasing the temperature set point of the fuser belt 810, 910 and heating the entire length of the fuser belt 810, 910 to the higher temperature set point with the heated rolls alone. Accordingly, the fuser assemblies 800, 900 can provide improved time and energy efficiency when used for printing thin and thick copy sheets, and coated and uncoated copy sheets, in the same apparatus.

Accordingly, embodiments of the fuser assembly, such as the fuser assembly 800 shown in FIGS. 2 to 5 and the fuser assembly 900 shown in FIG. 6, can be operated to use the heater 822, 922 as a supplemental heating device. The heater 822, 922 can be used to supplement heating of the fuser belt 810, 902 by the fuser roll 802, 902 and any other heated rolls supporting the fuser belt 810, 910. For example, the heating surface 824, 924 of the heater 822, 922, respectively, can be moved away from contact with the fuser belt 810, 910 when processing a thin sheet of paper; the heater 822, 922 can be powered at an intermediate heating level (e.g., at a medium power level of the heating elements 838, 938 of the heater 822, 922) for processing a sheet of medium-weight paper or a coated thin sheet of paper; and the heater 822, 922 can be powered at a full heating level (e.g., a high power level of the heating elements 838, 938) for processing a heavy-weight sheet of paper (which may be coated or uncoated). For example, the fuser assembly 800, 900 with the fuser belt 810, 910 running at about 150 pages per minute can consume about 2500 W to fuse thin sheets, and about 4000 W to fuse thick sheets. The heated rolls of the fuser assembly 800, 900 can supply the 2500 W of power, while the heater 822, 922 can be used to supply the additional 1500 W of power in a steady state mode, or on a rapid, as-needed basis.

In some embodiments, during processing of thick copy sheets and/or coated copy sheets, in addition to supplying heat to the fuser belt 810, 910 from the heater 822, 922 of the fuser assembly 800, 900, it may be desirable to also increase the level of power supplied from the heated rolls to the fuser belt 810, 910 to above the level needed to fuse toner on thin copy sheets, in order to minimize cooling of the portion of the fuser belt 810, 910 that is heated by the heater 822, 922 before reaching the nip 806, 906. The increased power level can be supplied to the heated rolls until after the thick sheet has been printed.

Another exemplary use of embodiments of the fuser assembly, such as the fuser assemblies 800, 900, is to provide tunable gloss on media by controlling the fusing set temperature. The capability of varying the gloss on a sheet-to-sheet basis allows for enhanced customer-controlled output for print jobs.

Another exemplary use of embodiments of the fuser assembly, such as the fuser assemblies 800, 900, is to control the temperature of the fuser belt 810, 910 as a function of the image content on copy sheets. For example, paper sheets with toner images that are primarily or exclusively text and, accordingly, are more easily fused, can be processed at lower fusing temperatures than paper sheets that have at least one toner image with higher-area coverage than such text. This use of the fuser assembly 800, 900 can be dictated on a sheet-by-sheet basis.

Embodiments of the fuser assembly, such as the fuser assemblies 800, 900, can be used for fusing toner in xerographic apparatuses that use oil for reducing offset, as well as in other "oil-less" apparatuses that use toner particles containing a release agent, such as wax, instead of using release oil. The structure and composition of the layers of the fuser belt 810, 910 can be varied depending on whether release oil is used or not used in the apparatus.

EXAMPLE

FIG. 8A shows an exemplary embodiment of a fuser assembly including a fuser belt supported on rolls, including a heated roll. A heater is in contact with a portion of the inner surface of the fuser belt. The heater has a planar heating surface in contact with the fuser belt. The fuser belt has a temperature $T_{BELT\ IN}$ when it reaches the heater and a temperature $T_{BELT\ OUT}$ after being heated by the heater.

FIG. 8B shows a series of curves representing the calculated temperature, $T_{BELT\ OUT}$, of the outer surface of the fuser belt at the outlet end of the planar heating surface of the heater of the fuser assembly depicted in FIG. 8A versus the contact length, $L_c$, between the heating surface and the inner surface of the fuser belt. The curves are for contact resistance values of 0.001 $m^2K/W$, 0.0005 $m^2K/W$, 0.00025 $m^2K/W$, and for complete contact (i.e., "perfect contact") between the inner surface of the fuser belt and the heating surface. In the calculations, the following values were used: temperature of the heating surface of the heater of 232° C.; contact length between the heating surface and the fuser belt of about 35 mm, 70 mm, 105 mm, 140 mm, 175 mm and 220 mm; air temperature of 25° C.; contact resistance with air of 0.1 $m^2K/W$; and fuser belt velocity of 702 mm/s.

As shown in FIG. 8B, for each different value of contact resistance between the inner surface of the fuser belt and the heating surface, $T_{BELT\ OUT}$ is increased by increasing the contact length, $L_c$. At a given value of $L_c$, as the contact resistance is decreased, $T_{BELT\ OUT}$ is increased. These calculations demonstrate that it is beneficial to minimize the contact resistance between the inner surface of the fuser belt and the heating surface to allow a shorter contact length (shorter heating surface having lower surface area) to achieve the desired fuser belt temperature.

The calculations also demonstrate that embodiments of the fuser assemblies, such as the fuser assembly 800 and 900, are capable of heating the fuser belt from a temperature, $T_{BELT\ IN}$, of about 170° C. (e.g., for fusing toner on thin paper) to a temperature, $T_{BELT\ OUT}$, of about 190° C. (e.g., for fusing toner on thick paper) within the estimated typical heater size constraints of the fuser assembly.

It will be appreciated that various ones of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A fuser assembly for fusing toner onto a copy sheet in a xerographic apparatus, the fuser assembly comprising:

a continuous fuser belt including an inner surface and an outer surface opposite the inner surface;

at least a first roll and a second roll which support the fuser belt, at least one of the first roll and second roll being adapted to heat the fuser belt;

a heater including an outer heating surface facing the inner surface of the fuser belt, the outer heating surface being curved outward; and a mechanism operatively connected to the heater for moving the heater to pivot at least a portion of the outer heating surface into contact with the inner surface of the fuser belt;

wherein the heater is operable to supply heat from the outer heating surface to the inner surface to increase the temperature of the outer surface of the fuser belt adjacent the inner surface heated by the outer heating surface.

2. The fuser assembly of claim 1, wherein the mechanism comprises a shaft attached to the heater and a motor connected to the shaft, the motor being operable to rotate the shaft to thereby pivot at least the portion of the outer heating surface into contact with the inner surface of the fuser belt.

3. The fuser assembly of claim 2, wherein:

the fuser belt is rotatable in a counter-clockwise direction; and the motor is operable to (i) rotate the shaft to pivot the heater counter-clockwise to a first position in which an upstream portion of the outer heating surface contacts the inner surface of the fuser belt, (ii) rotate the shaft to pivot the heater clockwise from the first position to a second position in which the upstream portion and a downstream portion of the outer heating surface contact the inner surface, and (iii) rotate the shaft to pivot the heater clockwise from the second position to a third position in which the downstream portion of the outer heating surface contacts the inner surface of the fuser belt.

4. The fuser assembly of claim 1, wherein the mechanism is operable to (i) translate the heater to move the outer heating surface into contact with the inner surface of the fuser belt, and (ii) move the outer heating surface away from the inner surface of the fuser belt.

5. The fuser assembly of claim 1, wherein the mechanism is adapted to move the heater relative to the inner surface to vary the amount of surface area contact between the outer heating surface and the inner surface of the fuser belt.

6. The fuser assembly of claim 1, wherein:

the heater comprises a first end, a second end opposite to the first end, an interior, and a heat source disposed in the interior, the heat source being operable to heat at least a portion of the outer heating surface;

the outer heating surface is comprised of metal and a coating of a lubricating material on the metal, the lubricating material being effective to reduce friction between the inner surface of the fuser belt and the outer heating surface in contact with the inner surface, and the outer heating surface has a length from the first end to the second end of about 150 mm to about 300 mm; and the fuser belt has a length of about 500 mm to at least about 1000 mm.

7. The fuser assembly of claim 1, further comprising:

a first idler roll disposed between the first roll and second roll and which supports the fuser belt;

a second idler roll disposed between the first idler roll and the second roll and which supports the fuser belt;

a third roll; and a nip defined between the outer surface of the fuser belt and the third roll;

wherein the heater is located along the fuser belt between the first idler roll and second idler roll.

8. A xerographic apparatus, comprising:

a fuser assembly according to claim 1 further comprising a third roll and a nip defined between the outer surface of the fuser belt and the third roll; and a sheet feeding apparatus for feeding a copy sheet having toner thereon to the nip;

wherein the fuser belt is rotatable to bring the outer surface of the fuser belt adjacent the inner surface heated by the outer heating surface into contact with the copy sheet to fuse the toner onto the copy sheet at the nip.

9. A fuser assembly for fusing toner onto a copy sheet in a xerographic apparatus, the fuser assembly comprising:

a continuous fuser belt including an inner surface and an outer surface opposite the inner surface;

at least a first roll and a second roll which support the fuser belt, at least one of the first roll and second roll being adapted to heat the fuser belt;

a third roll;

a nip defined between the outer surface of the fuser belt and the third roll;

a heater disposed between the first roll and second roll, the heater including an outer heating surface facing the inner surface of the fuser belt; and a mechanism operatively connected to the heater for moving the heater to bring at least a portion of the outer heating surface into contact with the inner surface of the fuser belt between the first roll and second roll, with the outer heating surface being spaced from the nip;

wherein the heater is operable to supply heat from the outer heating surface to the inner surface to increase the temperature of the outer surface of the fuser belt adjacent the inner surface heated by the outer heating surface.

10. The fuser assembly of claim 9, wherein:

the fuser belt is rotatable in a counter-clockwise direction;

the outer heating surface is curved outward; and the mechanism comprises a shaft attached to the heater and a motor connected to the shaft, the motor being operable to (i) rotate the shaft to pivot the heater counter-clockwise to a first position in which an upstream portion of the outer heating surface contacts the inner surface of the fuser belt, (ii) rotate the shaft to pivot the heater clockwise from the first position to a second position in which the upstream portion and a downstream portion contact the inner surface, and (iii) rotate the shaft to pivot the heater clockwise from the second position to a third position in which a downstream portion of the outer heating surface contacts the inner surface of the fuser belt.

11. The fuser assembly of claim 9, wherein:

the heater comprises a first end, a second end opposite to the first end, an interior, and a heat source disposed in the interior and adapted to heat at least a portion of the outer heating surface;

the outer heating surface is comprised of metal and a coating of a lubricating material on an outer surface of the metal, the lubricating material being effective to reduce friction between the inner surface of the fuser belt and the outer heating surface in contact with the inner surface, and the outer heating surface has a length from the first end to the second end of about 150 mm to about 300 mm; and the fuser belt has a length of about 500 mm to at least about 1000 mm.

12. A xerographic apparatus, comprising:

a fuser assembly according to claim 9; and a sheet feeding apparatus for feeding a copy sheet having toner thereon to the nip;

wherein the fuser belt is rotatable to bring the outer surface of the fuser belt adjacent the inner surface heated by the heating surface into contact with the copy sheet to fuse the toner onto the copy sheet at the nip.

13. A method of fusing toner onto a copy sheet in a xerographic apparatus, the method comprising:

heating a fuser belt including an inner surface and an outer surface with at least one of a first roll and a second roll which support the fuser belt, the outer surface and a third roll defining a nip;

heating at least a portion of the inner surface of the fuser belt between the first roll and second roll by contacting the portion of the inner surface with a heating surface of a heater, the heating comprising pivoting the heating surface relative to the inner surface to bring a selected portion of the heating surface into contact with the inner surface so as to vary the amount of heat supplied from the heating surface to the inner surface, the heating surface being curved outward and spaced from the nip;

conveying a first copy sheet having first toner thereon to the nip; and contacting the first copy sheet with a portion of the outer surface of the fuser belt opposite to the portion of the inner surface heated by the heating surface to heat the first toner to a first temperature effective to fuse the first toner onto the first copy sheet.

14. The method of claim 13, wherein:

the heater comprises a first end, a second end opposite to the first end, an interior, and a heat source disposed in the interior, the heat source being actuated to heat at least a portion of the heating surface during the heating of the portion of the inner surface; and the heating surface (i) has a length from the first end to the second end of about 150 mm to about 300 mm, and (ii) is comprised of metal and a coating of a lubricating material on the metal, the lubricating material reducing friction between the inner surface of the fuser belt and the heating surface in contact with the inner surface during the heating of the portion of the inner surface.

15. The method of claim 13, further comprising:

prior to heating at least the portion of the inner surface of the fuser belt between the first roll and second roll, conveying a second copy sheet, which is thinner than the first copy sheet and has second toner thereon, to the nip; and contacting the second copy sheet with a portion of the outer surface of the fuser belt opposite to a portion of the inner surface that has been heated exclusively by the at least one of the first roll and the second roll so as to heat the second toner to a second temperature effective to fuse the second toner onto the second copy sheet.

16. The method of claim 13, further comprising:

prior to heating at least the portion of the inner surface of the fuser belt between the first roll and second roll, conveying an uncoated second copy sheet having second toner thereon to the nip; and contacting the second copy sheet with a portion of the outer surface of the fuser belt opposite to a portion of the inner surface that has been heated exclusively by the at least one of the first roll and the second roll so as to heat the second toner to a second temperature effective to fuse the second toner onto the second copy sheet.

17. The method of claim 13, further comprising controlling the temperature of the portion of the outer surface of the fuser belt opposite to the portion of the inner surface heated by the heating surface so as to control a gloss of an image on the first copy sheet.

18. The method of claim 13, further comprising controlling the temperature of the portion of the outer surface of the fuser belt opposite to the portion of the inner surface heated by the heating surface based on an image content on the first copy sheet.

19. The method of claim 18, wherein the temperature of the heating surface is controlled based on a surface area of at least one image on the first copy sheet.

* * * * *